United States Patent [19]

Bright et al.

[11] 4,341,429

[45] Jul. 27, 1982

[54] ELECTRICAL CONNECTOR

[75] Inventors: Edward J. Bright, Elizabethtown; Glenn A. Engle, Hershey; William S. Scheingold, Palmyra, all of Pa.

[73] Assignee: AMP Incorporated, Harrisburg, Pa.

[21] Appl. No.: 198,493

[22] Filed: Oct. 20, 1980

[51] Int. Cl.[3] ..... H01R 13/62

[52] U.S. Cl. ..... 339/74 R; 339/75 R; 339/75 M; 339/75 MP

[58] Field of Search ..... 339/74 R, 75 R, 75 M, 339/75 MP

[56] References Cited

U.S. PATENT DOCUMENTS

| | | | |
|---|---|---|---|
| 2,982,883 | 5/1961 | Gordy . | |
| 3,594,698 | 7/1971 | Anhalt | 339/75 M |
| 3,763,459 | 10/1973 | Millis | 339/75 M |
| 4,189,199 | 2/1980 | Grau | 339/75 MP |
| 4,245,877 | 1/1981 | Auriana | 339/74 R |

FOREIGN PATENT DOCUMENTS

| | | | |
|---|---|---|---|
| 2028015 | 2/1980 | United Kingdom | 339/74 R |

OTHER PUBLICATIONS

Doody, IBM Technical Bulletin, vol. 17, No. 5, 10/74.

Babuka et al., IBM Technical Bulletin, vol. 21, No. 3, 8/78.

*Primary Examiner*—John McQuade

*Assistant Examiner*—Frank H. McKenzie, Jr.

*Attorney, Agent, or Firm*—Allan B. Osborne

[57] ABSTRACT

The present invention relates to a connector for electrically connecting a substrate having a plurality of depending pins to a printed circuit board. More specifically, the invention disclosed is an insulating housing with a movable cover adapted to open normally closed contacts positioned in the housing so that the pins may be inserted.

5 Claims, 11 Drawing Figures

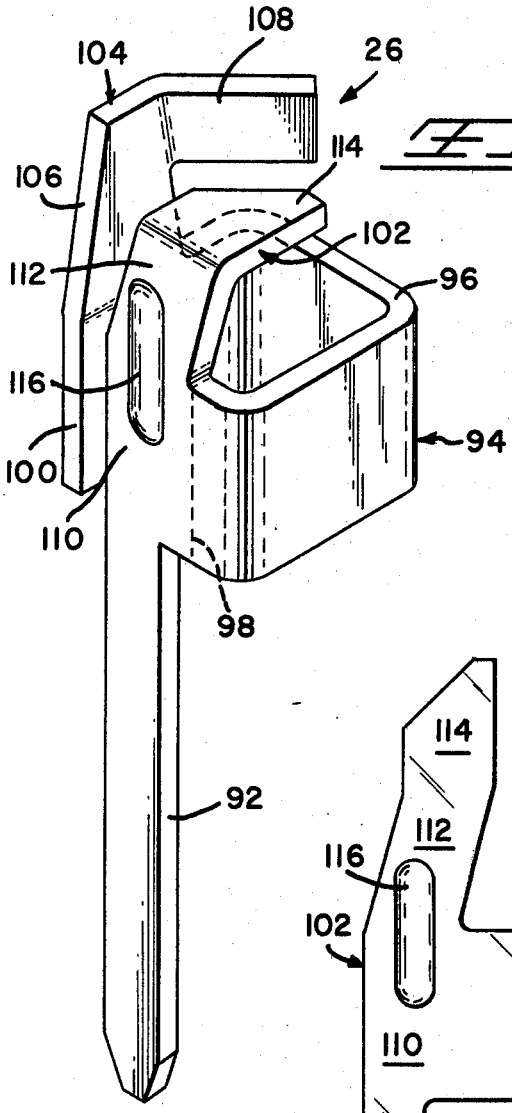
Fig. 3
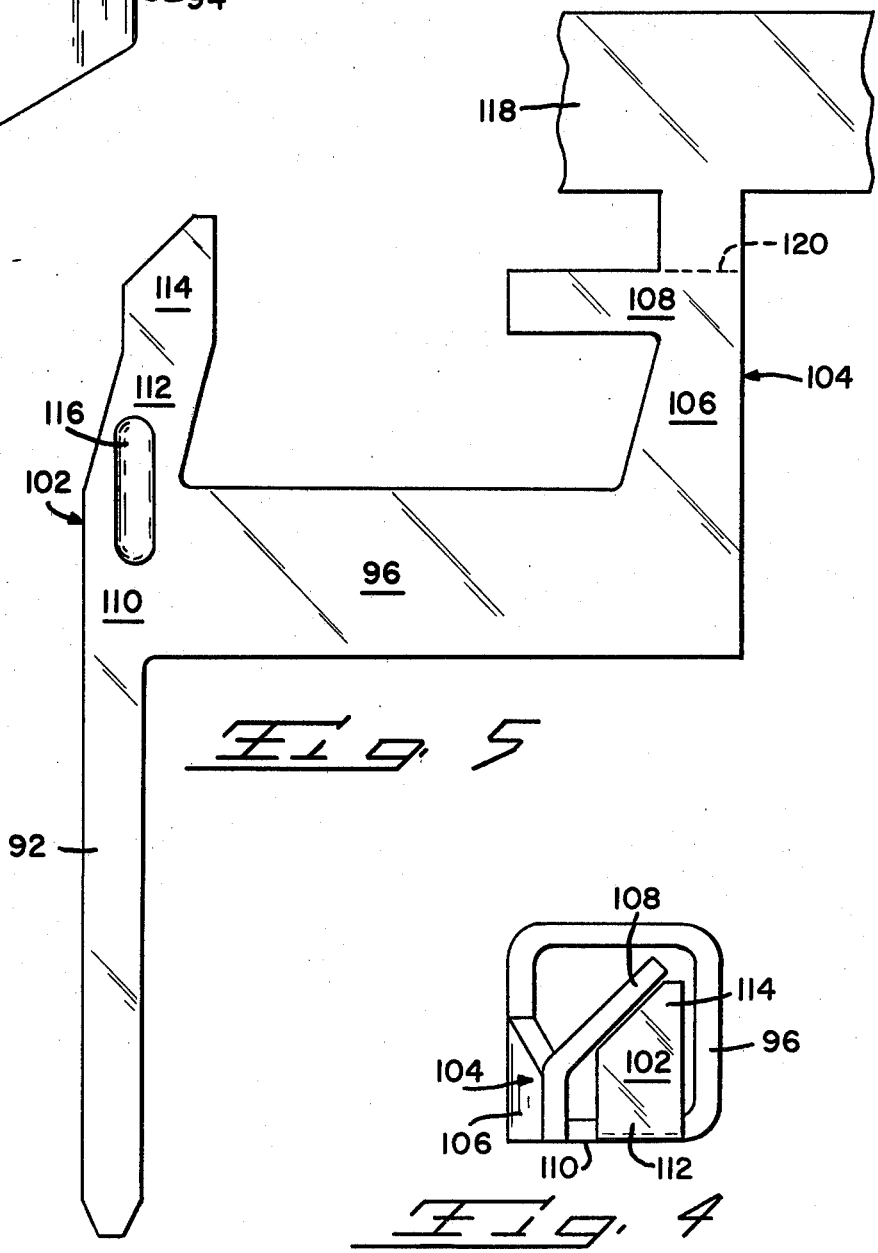
Fig. 5
Fig. 4

Fig. 8
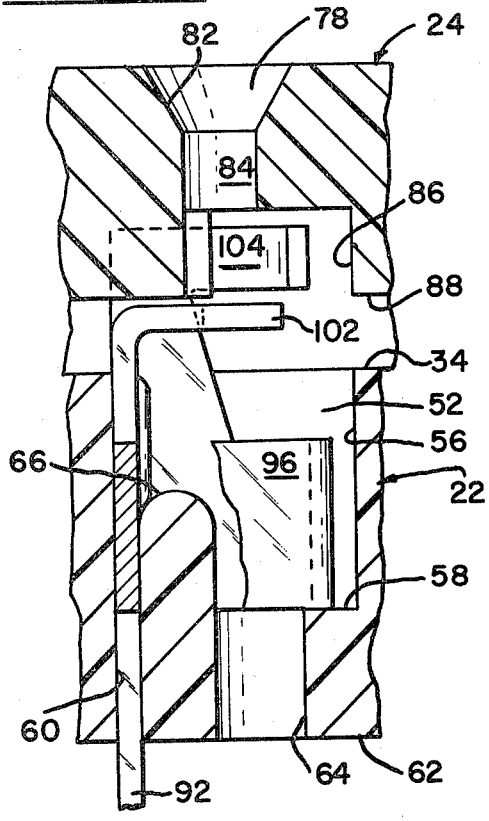
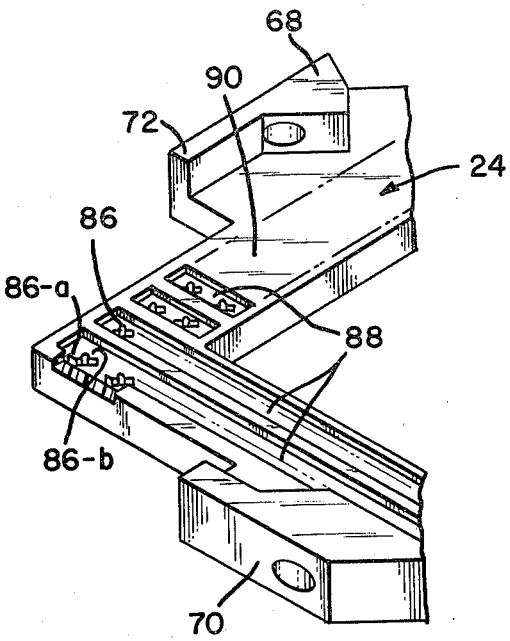
Fig. 11
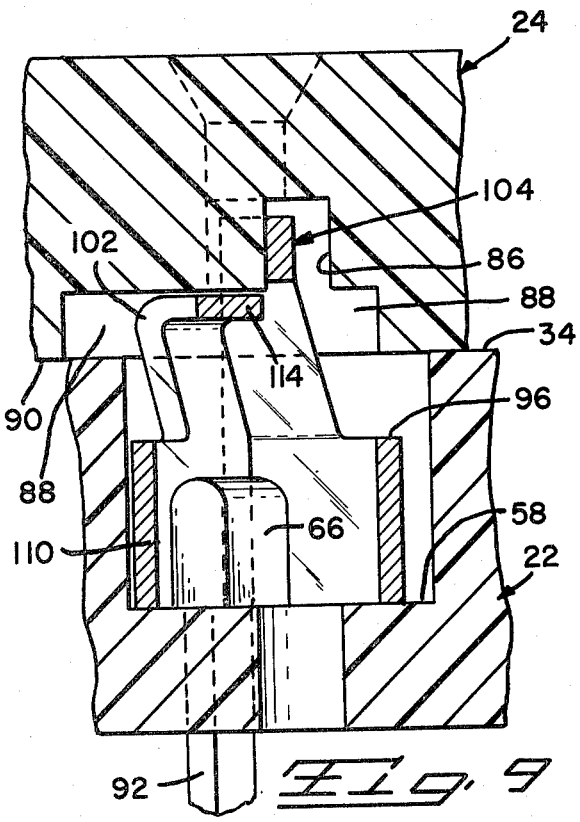
Fig. 9
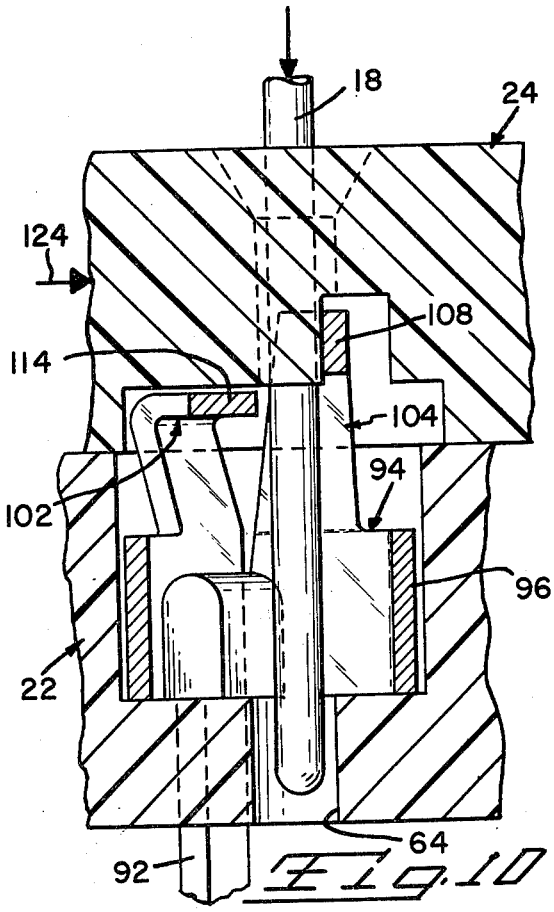
Fig. 10

ELECTRICAL CONNECTOR

BACKGROUND OF THE INVENTION

1. The Field Of The Invention

The invention disclosed herein relates to connectors which are generally soldered into a printed circuit board and into which substrate may be removably inserted. Contacts in the connectors electrically connect the substrate pins to traces on the circuit board.

2. The Prior Art

The present invention is a novel improvement and a departure from at least the following patent:

| U.S. Pat. No. | Patentee | Class/Subclass |
|---|---|---|
| 3,763,459 | Millis | 339/75 M |

Millis discloses two embodiments in the subject patent. In one embodiment the socket consists of a housing with three members, one stacked on another. The middle member moves back and forth between the upper and lower members that are fastened together. U-shaped contact members are positioned in the socket with the two "arms" or contact elements extending up through aligned openings in the middle and upper members. The contact elements are in the open position; i.e., spaced apart, in the relaxed position. The openings through which the contact elements extend have concave surfaces so that upon moving the middle member axially, the contact elements are only brought into engagement with DIP leads positioned thereinbetween but are wrapped around them partially to effect a good electrical contact.

The second embodiment is a socket adapted to engage pins or leads depending from a multi-pin type package. The socket is formed from three members stacked one on top of the other. The underside of the top member has a slot in which two sliding cam plates are positioned. Openings in the top member and plates are in aligned relationship. A cam rotatably positioned in the socket slides the cam plates in opposite directions simultaneously. Contacts are positioned in the socket with L-shaped upper ends extending up through the openings in the sliding plates. Each aligned openings receives two separate contacts. Upon inserting the pins into the openings and between the two L-shaped upper ends of the contacts, the rotation of the cam causes the opening walls to pivot the contact ends about the pins and into a pressure relation therewith for effective electrical termination.

SUMMARY OF THE INVENTION

The invention discloses a connector comprising a housing, a cover and a plurality of normally closed contacts. The housing provides the means for retaining the contacts which have a movable arm extending above the housing surface. The cover is slidably positioned on the housing and contains a plurality of openings into which the movable arms extend. By sliding the cover, means therein pull the movable arms back so that pins depending from a ceramic substrate may be inserted. Upon releasing the cover, the movable arms close against the pins to make electrical contact therewith.

BRIEF DESCRIPTION OF THE DRAWINGS

FIG. 1 is a perspective view showing a printed circuit board on which are positioned three connectors constructed in accordance with the preferred embodiment of the present invention: a fourth connector is shown over the PCB: further, a multi-pin ceramic substrate is shown plugged into a connector and another is shown prior to being plugged in;

FIG. 3 is an enlarged, perspective view of a contact of the present invention;

FIG. 4 is a top plan view of the contact of FIG. 3;

FIG. 5 is a stamped blank from which the contact is formed;

FIG. 8 is a side elevation section view taken along line 8—8 of FIG. 6;

FIG. 9 is a side elevation section view taken along line 9—9 of FIG. 6;

FIG. 10 is a side elevation section view taken along line 10—10 of FIG. 7; and

FIG. 11 is a view looking in at the underside of the cover of the connector.

DESCRIPTION OF THE INVENTION

Figure 1:
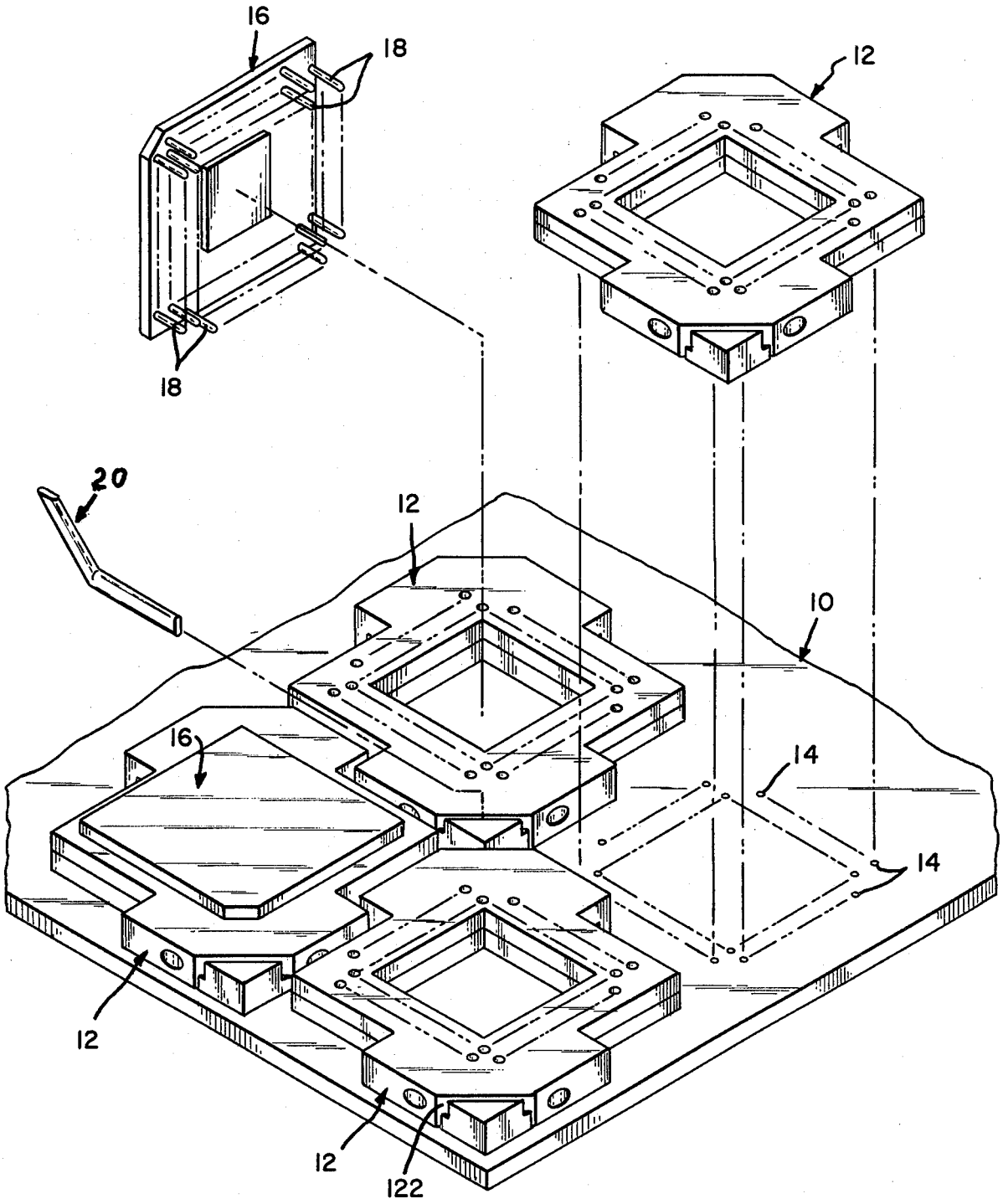

FIG. 1 is a drawing showing a printed circuit board 10 on which are mounted three connectors 12 constructed in accordance with the present invention. A fourth connector is shown above the board so as to expose plated-through holes 14 (on the board) into which the tails on the contacts in the connectors are soldered. Other ways of terminating the connectors to the board may also be used. Also shown are two ceramic substrates 16, one plugged into a connector and the second above the board to show its pins 18 projecting from the substrate's underside. Finally, a tool 20 is shown. This tool, which is oval in cross-section and bent to provide a lever, is used to open the normally closed contacts to admit or withdraw substrate 16.

Figure 2:
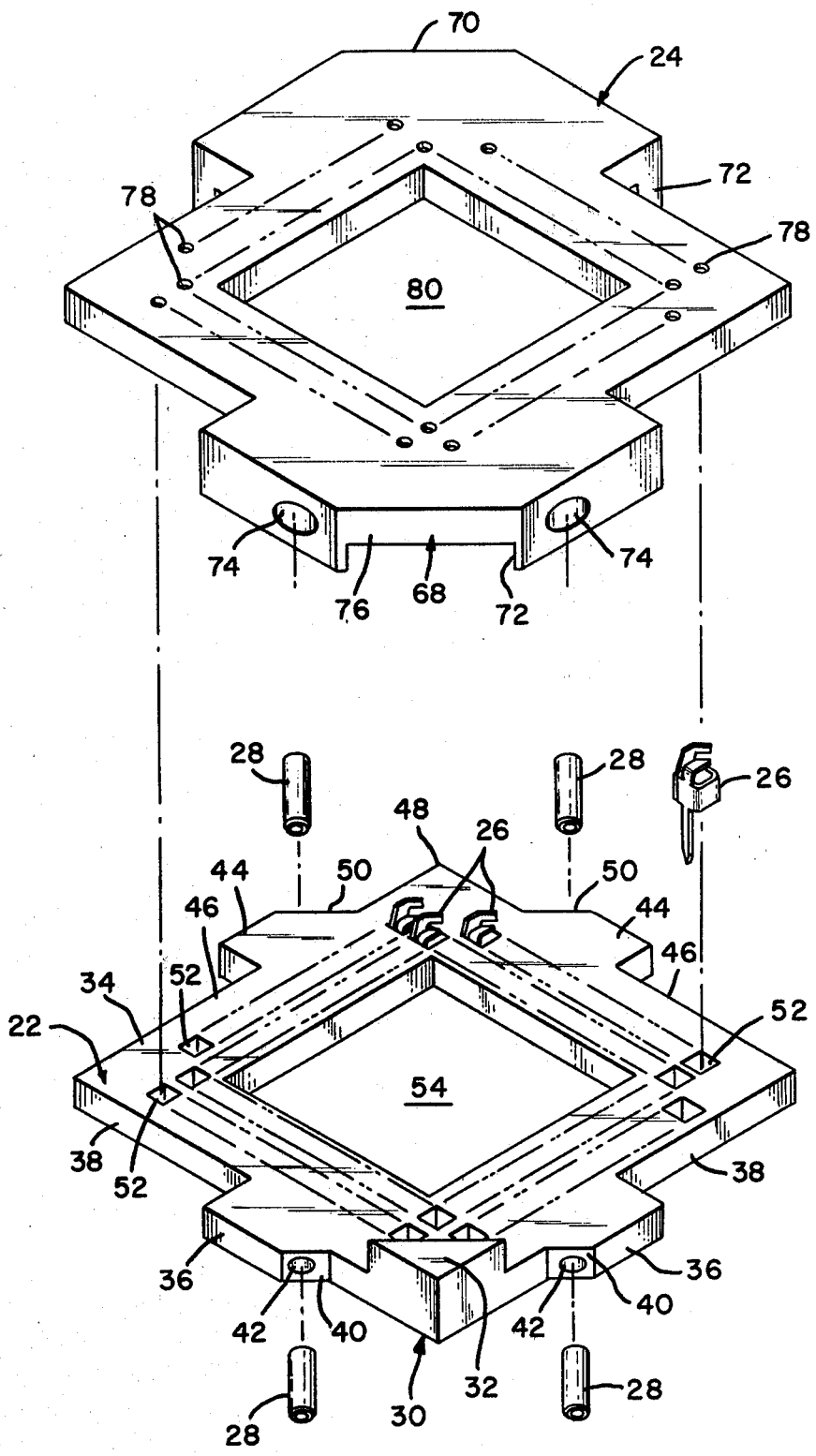
FIG. 2 is an enlarged perspective, exploded view of a connector of FIG. 1 showing the several components thereof.

FIG. 2 shows an exploded connector 12 so as to illustrate the several components involved. included is a housing 22, cover 24, contacts 26 and roll pins 28.

Housing 22 is preferably molded using an insulating plastic. One such material is sold by Phillips Chemical Co. under the tradename Ryton R-4.

The housing as viewed from above is substantially square except for forward corner 30. The corner and adjacent sides project outwardly an additional distance. A triangular-shaped wall 32, located on corner 30, rises above upper surface 34 of the housing.

Two ears 36 project laterally outwardly from sides 38 adjacent to corner 30. Both ears have a forwardly facing bevelled side 40 into which holes 42 penetrate. These holes receive roll pins 28 in a tight frictional or interference fit.

A pair of laterally projecting ears 44 are located on sides 46 adjacent the rearwardly facing corner 48. These ears also have bevelled sides 50 (facing rearwardly) with holes (not shown) to receive two more roll pins 28.

Vertical, contact receiving cavities 52 are provided in the housing in a predetermined pattern depending on the type of ceramic substrate to be received. For the substrate type shown, cavities 52 are arranged in a square pattern around a large central opening 54 extending through the housing. The large opening provides clearance for the cover on the ceramic substrate.

The internal configuration of a cavity 52 and connecting openings thereto are shown in FIGS. 8, 9 and 10 to which reference is now made. Please note that the view in FIG. 8 is taken at an angle of forty-five degrees relative to the views of the latter two Figures. Also cover 24 is in place in the three Figures. From the opening onto surface 34 of the housing the cavity walls 56 extend straight down to a cavity floor 58. A contact tail-receiving passage 60 extends downwardly from the cavity floor to open out onto the underside surface 62 of the housing. As shown in FIG. 8, passage 60 is located at one side of the cavity. A pin 18-receiving opening 64 extends down from floor 58 to the underside surface (see FIG. 10).

A tombstone-shaped post 66 projects upwardly from cavity floor 58. The post is located on the floor between passage 60 and opening 64.

Cover 24, shown most clearly in FIG. 2, is basically square but with two opposite, enlarged corners 68 and 70. Each of the enlarged corners have skirts 72 which extend down over the sides of the ears on housing 22 when the cover is in place. Holes 74 in the skirts slidingly receive roll pins 28 which vertically holds the cover on the housing while permitting it to slide back and forth on top thereof.

The tip of corners 68 and 70 are truncated so that, with respect to corner 68, the flat surface 76 resulting from the truncation is spaced behind upstanding wall 32 on housing 22. FIG. 1 shows this arrangement. The shortest space between the surface and wall is wide enough to admit tool 20 when it is orientated as shown in FIG. 1.

A plurality of vertical openings 78 are positioned in cover 24 in the same pattern as the cavities in housing 22. This is shown in FIG. 2. The cover further has central opening 80 to accommodate the cover on substrate 16.

Figure 6:
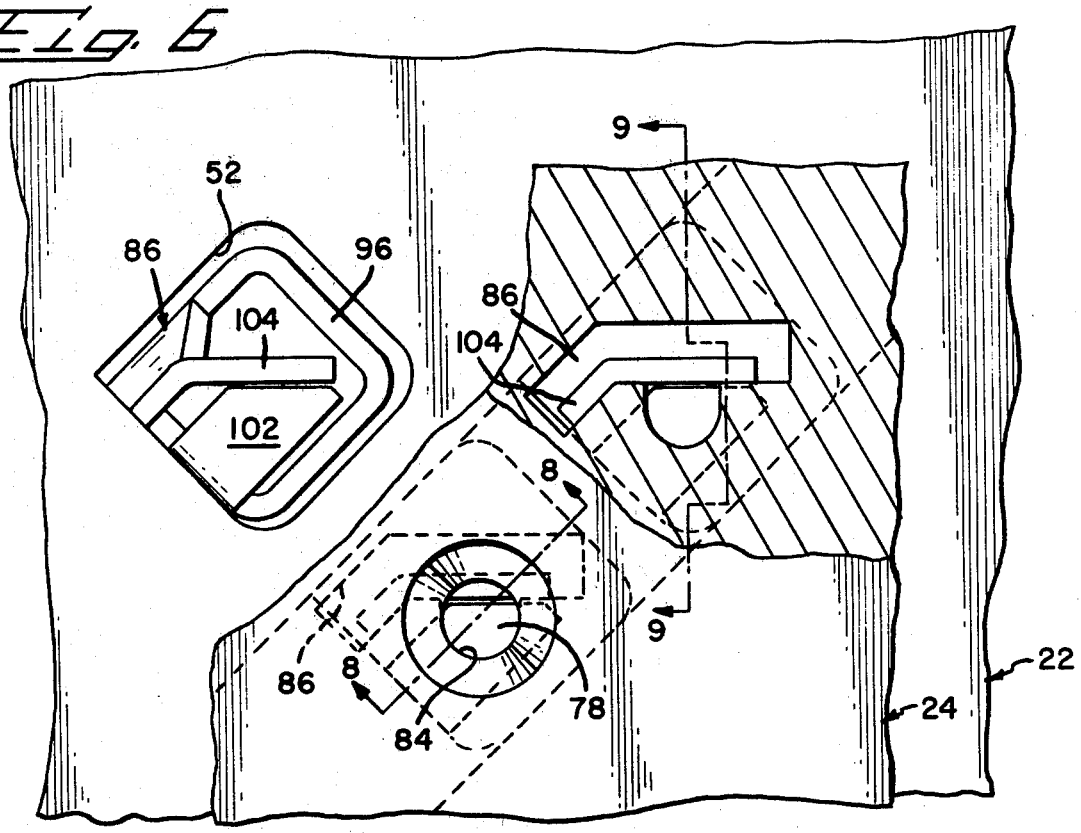
FIG. 6 is a top plan view which illustrates the connector of FIG. 1 in a rest position.
Figure 7:
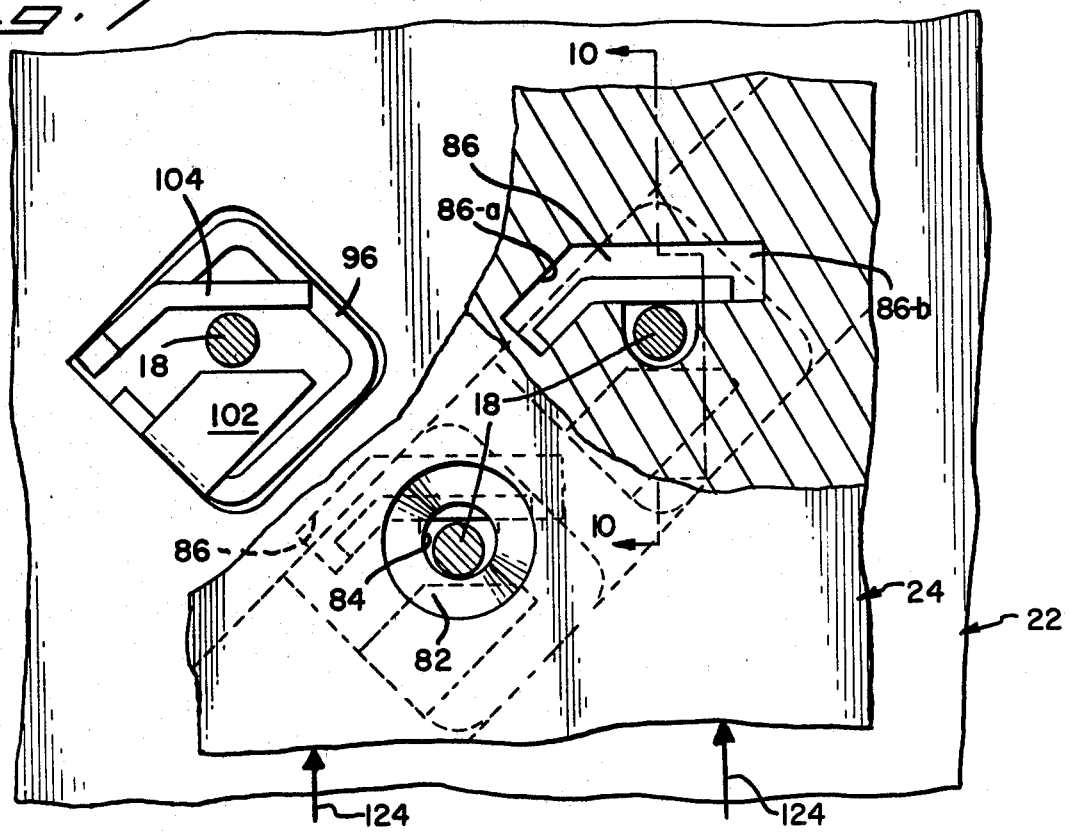
FIG. 7 is a top plan view which illustrates the connector of FIG. 1 in an open position.

The configuration of the openings may be seen in FIGS. 8 through 11. As shown in FIG. 8, the upper section of the openings is funnel shaped as indicated by reference numeral 82. A short straight-wall section 84 connects the funnel section to an elongated slot section 86. The slot, shown clearly in FIG. 11, has first and second sections **86*a* and 86*b*, one being at an angle to the other. FIGS. 6 and 7 also show the slot. Note that one side wall of slot section 86*b* is a downward continuation of section 84. Again, FIGS. 6 and 7** will show this more clearly.

With reference to FIG. 11, slots 86 open out downwardly into elongated grooves 88 which are provided in the underside 90 of cover 24.

An enlarged drawing of a contact 26 is shown in FIG. 3 to which reference is now made. The contact has two sections: tail 92 which is soldered into hole 14 on printed circuit board 10 and spring section 94. Tail 92 is a straight shaft with a bevelled tip. As noted above, tail 92 represents any means for electrically connecting the contacts to a printed circuit board or the like.

Spring section 94 is a complex design which utilizes both bending and twisting to develop the required compressive force against pin 18 on the ceramic substrate. Since space is limited in the connector, both horizontally and vertically, the distance through which the normally closed contact can be opened to admit the pin is quite small. Accordingly, the efficiencies of both a cantilever beam and torsional bar are combined in the spring section to provide the required high compressive forces. The structure which supplies the combined forces include a web 96 which begins at the dashed line indicated by reference numeral 98. The web extends around three right angle corners so that its free end 100 is adjacent to the fixed arm 102 of the spring section; i.e., the web is attached to one edge of the fixed arm and extends therearound so that the free end (of the web) is adjacent the opposite edge of the fixed arm. The web describes a square or box-like shape: whereas it could be circular, the box-like shape shown provides a longer length and greater torsional effects.

Movable arm 104 is located on top of the web above free end 100. This arm has a vertical part 106 and horizontal finger 108 with the latter being bent around to lie at an angle of 45° relative to the vertical part. Arm 104 is formed to a position that will allow it to apply maximum force against pin 18 to maintain electrical contact therewith when the pin is in between arms 104 and 102. FIG. 4, a top plan view, shows this formed position.

Fixed arm 102 extends upwardly from tail 92. The lower portion 110, attached to the tail, is coextensive with web 96, the middle portion 112 is bent in slightly and the upper portion 114; i.e., the free end, is bent further to lie horizontally. A dimple or embossment 116 which is located in portions 110 and 112 provides stiffness for fixed arm 102.

FIG. 5 is contact 26 after being stamped or blanked out of a coplanar strip of metal and embossed but prior to being formed up. The reference numerals thereon indicate the formed structural parts of the contact shown in FIGS. 3 and 4. The drawing also shows carrier strip 118 in that the preferred way of making the contacts is by means of continuous stamping and forming methods. Dashed line 120 shows the place where the contact is broken away from the carrier strip.

The assembly of the several components first requires contacts 26 being placed in cavities 52 in housing 22. The location of the tail-receiving passage 60 predetermines the positioning of the spring section; i.e., the lower portion 110 of the fixed arm lies between one wall of the cavity and post 66 (FIG. 9). The fixed arm thus cannot move horizontally. Web 96 rests on floor 58. Both arms 102 and 104 extend above surface 34 of the housing. Tail 92 extends down below the housing.

With contacts 26 in place, cover 24 is placed over the housing. Skirts 72 cover the sides of the ears and flat surface 76 on forward corner 68 lies behind wall 32 on the housing with the space therebetween defining slot 122 (FIG. 1). The rest of the cover slidingly rests on surface 34. With the cover so positioned, movable arm 104 on the contact is positioned in slot 86 (FIGS. 6, 8 and 9). Fixed arm 102, particularly the free end 114 thereof, is in groove 88.

With the cover in position, roll pins 28 are inserted into housing holes 42 through cover holes 74 to hold the cover onto the housing but with freedom to move back and forth.

As noted above, the contacts are formed so that they are normally closed. An assembled connector without pins inserted thereon is shown in FIGS. 6, 8 and 9. FIG. 6 shows three loaded cavities; the upper left cavity is exposed; i.e., the cover removed, the upper right cavity has a portion of the cover removed; i.e., down to slot 86, and the lower center cavity has the cover in place and the cavity and contact being shown in phantom. Note that movable arm 104 is almost but not quite touching fixed arm 102.

To plug ceramic substrate 16 into connector 12, contacts 26 must first be opened. This is done by inserting tool 20 into slot 122 and rotating it. A screwdriver tip (not shown) inserted into the slot and turned would also work. The rotating tool forces cover 24 back towards rearward corner 48 (on housing 22). With movable arm 104 in slot 86, the rearward movement draws that arm away from fixed arm 102; i.e., its free end 114. FIGS. 7 and 10 illustrate this condition. The drawings therein also show pin 18 inserted between the two arms. Arrows 124 in FIGS. 7 and 10 indicate the direction cover 24 is moved.

As the movable arm is pulled back, it and web 96 bend and twist so that considerable force is stored in the two components over a relatively short displacement.

Upon removing tool 20 from slot 122, the induced forces in movable arm 104 and web 96 force the cover back towards the rest position of FIG. 6. With pins 18 positioned in between arms 102 and 104, arm 104 cannot fully return and thus considerable compressive forces are exerted on the pin.

Substrate 16 is removed by the same process; i.e., forcing cover 24 rearwardly to open contacts 26 so that it can be withdrawn.

The present invention may be subject to many modifications and changes without departing from the spirit or essential characteristics thereof. The present embodiments are therefore to be considered in all respects as illustrative and not restrictive as to the scope of the invention.

What is claimed is:

1. A connector for receiving and electrically connecting a ceramic substrate or like device having a plurality of pins depending therefrom to a printed circuit board or the like, said connector comprising:

a. a housing of insulating material having a plurality of cavities extending thereinto from the upper surface thereof, a passage from each cavity extending to and opening out on the underside of the housing;

b. a cover of insulating material slidably mounted on the upper surface of the housing and having a plurality of slots extending upwardly into the cover from its underside and a plurality of openings extending downwardly from the upper surface of the cover and intersecting the slots, said slots and openings being positioned in the cover in the same pattern as the cavities in the housing;

c. a plurality of contacts stamped and formed from conductive material and having;

i. means adapted for being electrically connected to a printed circuit board or the like, ii. a fixed arm having a lower portion attached to and extending generally upwardly from said means and an upper portion bent in to lie generally at about a right angle to the lower portion, iii. an elongated web attached to one edge of the lower portion of the fixed arm and extending therearound with a free end being adjacent to the opposite edge of the lower portion, and iv. a movable arm attached to and extending upwardly from the web adjacent the free end thereof, said movable arm extending above and being generally normal to the free end of the fixed arm and adjacent thereto, said contacts being positioned in the cavities in the housing with said means extending therebefore for attachment to a printed circuit board or the like and the movable arm extending up into the slots in the cover, so that upon sliding the cover, the movable arms are drawn away from the fixed arms to admit therebetween the pins on a ceramic substrate or the like for electrical contact therewith.

2. The connector of claim 1 wherein the web describes a box-like shape.

3. The connector of claim 2 wherein the movable arm includes a vertical part attached to and extending upwardly from the web and a finger extending laterally from the vertical part.

4. The connector of claim 3 wherein the finger is bent in towards the free end of the fixed arm.

5. The connector of claim 4 wherein the cavities include means for retaining the fixed arm against horizontal movement.

* * * * *